US008080768B2

(12) United States Patent
Adam et al.

(10) Patent No.: US 8,080,768 B2
(45) Date of Patent: Dec. 20, 2011

(54) ARRANGEMENT FOR A COOKTOP AND A WORKTOP

(75) Inventors: Christoph Adam, Mehring (DE); Bernd Martin, St. Georgen (DE); Markus Schlegel, Bretten (DE); Thomas Stein, Taufkirchen/Vils (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 475 days.

(21) Appl. No.: 12/291,815

(22) Filed: Nov. 12, 2008

(65) Prior Publication Data

US 2009/0127247 A1 May 21, 2009

(30) Foreign Application Priority Data

Nov. 20, 2007 (DE) ..... 10 2007 055 312

(51) Int. Cl.
*H05B 3/68* (2006.01)
*F24C 15/10* (2006.01)

(52) U.S. Cl. ..... 219/452.11; 126/211

(58) Field of Classification Search .... 219/443.1–468.2; 126/211, 217

See application file for complete search history.

(56) References Cited

U.S. PATENT DOCUMENTS

| | | | | |
|---|---|---|---|---|
| 4,492,217 | A * | 1/1985 | Scheidler | 126/39 B |
| 5,036,831 | A * | 8/1991 | Ray | 126/211 |
| 5,399,839 | A * | 3/1995 | Taplan et al. | 219/452.12 |
| 6,252,205 | B1 | 6/2001 | Schultheis et al. | |
| 6,492,623 | B1 * | 12/2002 | Vilato et al. | 219/452.11 |

FOREIGN PATENT DOCUMENTS

| | | |
|---|---|---|
| EP | 1 515 092 | 3/2005 |
| EP | 1 734 308 | 12/2006 |
| EP | 1 818 619 | 8/2007 |

OTHER PUBLICATIONS

National Search Report DE 10 2007 055 312.0.

* cited by examiner

*Primary Examiner* — Sang Paik
(74) *Attorney, Agent, or Firm* — James E. Howard; Andre Pallapies

(57) ABSTRACT

An arrangement with a worktop and a cooktop with a cooking surface, a mounting frame and a decorative frame, which is arranged in a recess in the worktop, with the distance elements, embodied for relative positioning of the cooktop in relation to the recess and on which the cooktop rests, being arranged between the cooktop and the worktop.

19 Claims, 3 Drawing Sheets

ARRANGEMENT FOR A COOKTOP AND A WORKTOP

BACKGROUND OF THE INVENTION

The invention relates to a cooktop with a cooking surface, a mounting frame and a decorative frame which is arranged in a recess of a worktop.

Such an embodiment of a cooktop is generally known. In such cases the cooktops are arranged recessed in at least some areas into the cutout of the worktop and also extend partly above the level of the upper side of the worktop.

With a known cooktop there is provision for the cooking surface embodied from glass ceramic to be supported directly on the upper side of the worktop or to rest there, which however results in the height with which the cooktop extends above the level of the upper side of the worktop being relatively small and the height of the decorative frame not being allowed to exceed the thickness of the glass ceramic. In addition embodiments are known in which profiles, which are mostly embodied from aluminum, are glued on underneath the glass ceramic. This is however very complex and cost-intensive and in addition joint gaps which are undesirable also occur, at least in the corner areas. In addition with these designs spaces must be ensured between the worktop section and the cooktop housing with separate distance pieces. Last but not least, with the known embodiments, problems arise to the extent that forces acting on the cooktop which are transmitted to the worktop are transmitted through the decorative frame, which thus becomes part of the force flow path. This is associated with relatively high levels of wear on the glued joint between the decorative frame and the glass ceramic, and thereby might reduce the lifetime of this joint through the high stresses. Last but not least, with known cooktops the positioning of these in recesses is relatively difficult with respect to maintaining spacing which is essentially the same all around, which means that the worktop can be subjected to high temperatures at specific points in an undesired manner.

SUMMARY OF THE INVENTION

The object of the present invention is to create an arrangement with a cooktop which can be positioned accurately in the recess of a worktop and which in addition does not transmit forces acting on the cooktop via the decorative frame to the worktop.

An inventive arrangement comprises a worktop with a recess and a cooktop. The cooktop comprises a cooking surface, a mounting frame and a decorative frame and is arranged in a recess in the worktop. Distance elements are arranged between the cooktop and the worktop which are embodied for relative positioning of the cooktop in relation to the recess and on which the cooktop rests. This embodiment allows the defined positioning of the cooktop in the worktop in a simple and reliable manner and in addition enables it to be guaranteed that forces acting on the cooktop will not be transmitted via the decorative frame to the worktop. This means that wear can be reduced and especially the points at which the decorative frame joins the cooking surface are not subject to unnecessary stresses and strains. An arrangement is thus provided with a cooktop and a worktop for which the relative positioning between the cooktop and the worktop can be undertaken very exactly and durably. For this purpose the distance elements are provided, which maintain the position of the cooktop in the recess of the worktop in a defined manner, so that a distance between the cooktop and the worktop can be guaranteed such that the worktop is not subject to any undesired temperature stresses. Above and beyond this the distance elements are also designed as supports for the cooktop, so that forces acting on the cooktop especially from the cooking surface are conducted directly via the distance element into the worktop. Since in this respect the distance elements are embodied with significantly more stability, the force path conducted through them can guarantee that the force is introduced into the worktop with less wear.

Preferably a distance element is embodied as an angled part and extends with a first part into the recess and is arranged between the edge of the recess and the cooktop. In particular a distance element extends into the recess and a mounting frame of the cooktop rests on the distance element, especially on a rear side of a first part of the distance element. An undesired displacement of the cooktop relative to the worktop and thus an undesired reduction of the distance between the cooktop, especially a mounting frame, and the worktop can then be prevented by the massive distance element.

Preferably a distance element is embodied as an angled part and a second part of the distance element rests at least in some areas on the upper side of the worktop. This embodiment almost makes a wedging of the distance element possible, so that on the one hand it can be arranged positionally stable and on the other hand the positioning of the cooktop relative to the worktop is enabled in a number of spatial directions, especially in all three spatial directions. The desired or demanded spacings in the x-, y- and z-direction between the worktop and the cooktop can thus be reliably and durably set and guaranteed by these distance elements.

A distance element is especially embodied in one piece, which allows the number of parts in the arrangement or the cooktop to be reduced. In addition the stability of the distance element in respect of its multiffunctionality of guaranteeing the spacing on the one hand and force transmission on the other hand can be fulfilled especially well by this embodiment.

A distance element is especially embodied from plastic, which guarantees simple and cost-effective manufacturing and in addition enables a part having minimal weight to be provided.

Preferably the distance element extends beyond the level of the upper side of the worktop and the cooking surface of the cooktop rests on the distance element. It has proven especially preferable for the distance element to have a height which is above the upper side of the worktop which is dimensioned so that the decorative frame is arranged spaced from the upper side of the worktop. This enables the load on the decorative frame to be almost fully relieved and forces acting on the cooking surface are not transmitted via the decorative frame to the worktop. Preferably the spacing between the decorative frame and the upper side of the worktop is provided by a minimal gap, which is preferably dimensioned so that no contaminants or suchlike can get into or flow into the gap.

Naturally however there can also be provision for the decorative frame to be connected to the upper side of the worktop, but for this preferably to be done so that in respect of the weight force only a light contact is provided.

In particular a distance element is arranged to make a form fit between the mounting frame of the cooktop and the worktop. This type of form-fit mounting enables a redundant safety feature to be guaranteed. If the connection between the mounting frame and the cooking surface, especially the glass ceramic, which can be a glued joint, fails, the distance element prevents it falling down onto the floor along with the individual parts attached to the mounting frame.

Preferably the ends of the distance element are embodied tapered. In particular there is provision for at least one of the ends to be embodied as a wedge shape. This especially tapered embodiment on the one hand enables installation to be simplified, since introduction and placement can be simplified, and on the other hand enables the dimensioning of the distance element to be reduced, which also makes a space-saving and weight-saving embodiment possible.

Preferably one end of the distance element is tapered down towards the cooktop and a second end tapered down towards the upper side of the worktop. In particular the second part, which preferably rests on the upper side of the worktop, is tapered down towards this upper side. The second part, which extends downwards between the mounting frame and the wall of the recess, is preferably tapered towards the mounting frame.

In a preferred manner a distance element is arranged in its installed state with its upper side on a higher level than the front edge of a mounting frame of the cooktop. The cooking surface thus preferably rests only against the upper side of the distance elements.

In particular there is provision for the distance elements to be embodied and arranged so that the cooktop is positioned on the worktop without being in contact with it. This thus means that the cooktop is only in direct mechanical contact with the distance element but not with the worktop, and on the other hand the worktop is likewise only in mechanical contact with the distance element but not with the cooktop.

A distance element thus functions as a spacer and also as a support part.

Such an embodiment of an arrangement with the cooktop and the worktop as well as these distance elements enables it to be guaranteed that the cooktops with a greater installation height can be arranged above the upper side of the worktop. Last but not least this enables new design requirements to be taken into account. A precise match to the height of the device by the plastic injection-molded parts of the distance element can be guaranteed with very exact tolerances. A distance element is also provided as a multifunctional component. Special geometries, in which a leg or a part of the distance element protrudes in relation to the installation height above the level of the mounting frame, also help in positioning during the installation of the housing cover.

BRIEF DESCRIPTION OF THE DRAWINGS

An exemplary embodiment of the invention will be explained in greater detail below with reference to schematic drawings. The figures are as follows.

In the figures the same elements or those with the same function have been labeled with the same reference symbols.

DETAILED DESCRIPTION OF EXEMPLARY EMBODIMENTS

Figure 1:
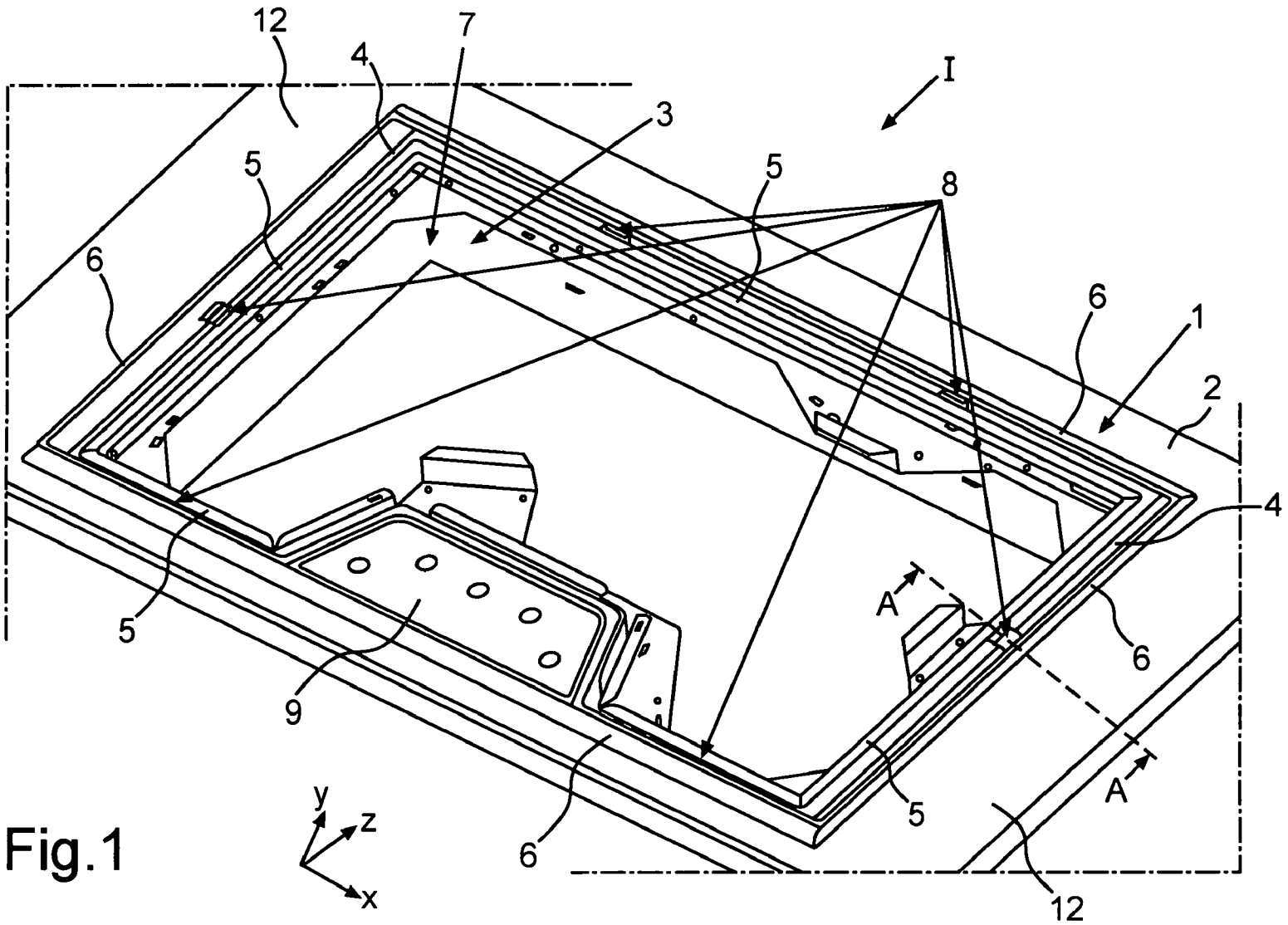
FIG. 1 a perspective view of an inventive cooktop which is arranged in a worktop.

FIG. 1 shows a perspective view of an arrangement I, in which a cooktop 1 is arranged in a worktop 2. To this end the worktop 2 comprises a recess or an opening 3, in which the cooktop 1 is arranged at least partly recessed. The cooktop 1 is arranged spaced around its entire circumference from an edge 4 of the opening 3.

The cooktop 1 comprises a mounting frame 5, which is embodied to surround it completely. In addition the cooktop 1 includes a decorative frame 6, which is likewise embodied to completely surround it and is arranged above the upper side 12 of the worktop 2.

A cooking surface 7, which is embodied from glass ceramic, and on which food preparation vessels for preparing foodstuffs can be placed, is arranged between the decorative frame 6 and the mounting frame 5 and held by said frames. To better illustrate the embodiment of the cooktop 1 and further components this cooking surface 7 is not shown in FIG. 1 or is shown as transparent.

The arrangement I additionally includes a plurality of distance elements 8, of which six are shown in the embodiment depicted in FIG. 1. This number is merely an example and can be more or also less than this. In particular there is provision for at least one such distance element 8 to be arranged on at least each side of the rectangular cooktop 1 and the rectangular opening 3 in the worktop 2 depicted in the exemplary embodiment. The distance elements 8 are arranged between the cooktop 1 and the work top 2 and are provided for relative positioning of the cooktop 1 in relation to the recess or opening 3, with the cooktop 1 also resting on the distance elements 8.

The cooktop 1 also includes an insert 9, which is embodied as a control unit or display unit. The insert 9 can feature printing such as symbols and/or a scale through which for example settings can be made or values of operating parameters can be displayed. Positioned below the insert 9 is a circuit carrier, which can at least also feature a light source and for example also one or more seven-segment displays.

The distance elements 8 are arranged so that the cooktop 1 is arranged without direct and thus without immediate mechanical contact with the worktop 2. The distance elements 8 function on the one hand as spacers and on the other hand as supports.

Figure 2:
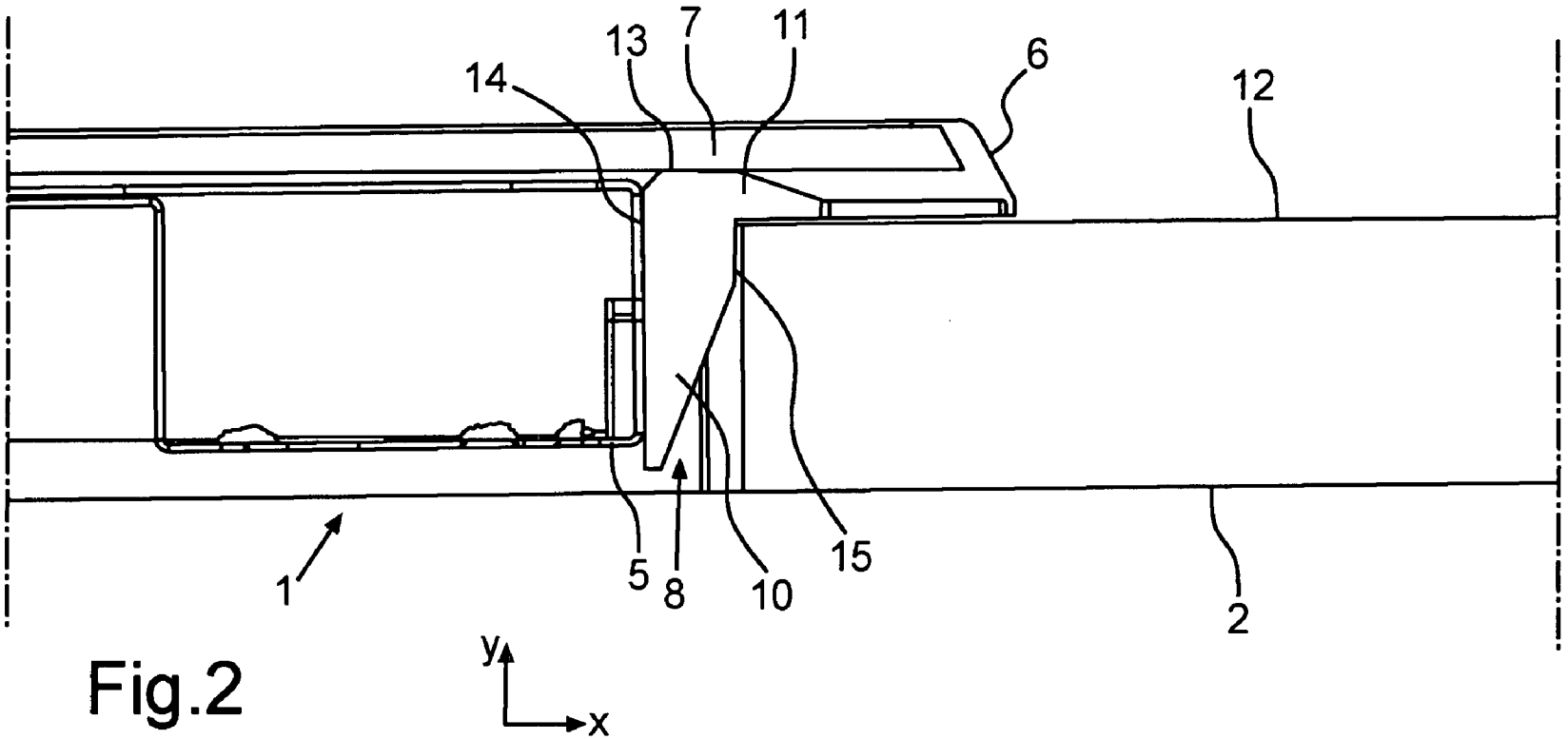
FIG. 2 a cross-sectional view through a part of the diagram depicted in FIG. 1.

FIG. 2 shows a cross-sectional view along the cut line AA in accordance with FIG. 1. The distance element 8 shown therein is embodied in one piece from plastic and has an angled shape. The distance element 8 comprises a first part 10, which extends in the vertical direction (y-direction) between the mounting frame 5 and the wall or the edge 4 of the opening 3. In addition the distance element 8 includes a second part 11, which is essentially embodied as a horizontal leg and rests on the upper side 12 of the worktop 2. The first part 10 is narrowed at its end facing away from the second part 11, especially tapered and thus exhibits the form of a wedge in this respect. The tapering is designed to be towards the direction of the mounting frame 5. The second part 11 also features a narrowed, especially tapered shape in the direction of an end facing away from the mounting frame 5, which is embodied towards the direction of the upper side 12. The first part 10 rests directly with its rear side 14 on the mounting frame 5, with it resting with its front side 15 on the edge 4. The second part 11 has an essentially flat upper side 13, on which the cooking surface 7 rests.

As the diagram in accordance with FIG. 2 shows, the decorative frame 6 has a minimal space from the upper side 12 or in any event rest only lightly or is in light contact with the upper side 12. The distance element 8 enables on the one hand an exact and durable relative positioning between the cooktop 1 and the worktop 2 to be guaranteed and in addition an effective transfer of force from the cooking surface 1 via the distance element 8 into the worktop without a force transfer or a significant force transfer taking place via the decorative frame 6 onto the worktop 2. The distance elements 8 are arranged to make a form fit between the mounting frame 5 and the worktop 2. As well as their functionality of guaranteeing the spacing on the one hand and acting as supports on the other hand, a redundant safety feature can also be guaranteed in this manner. The cooking surface 7 is glued to the mounting frame 5.

From the diagram shown in FIG. 2 it can be seen that the distance element 8 extends in the y-direction above the level of the installation height of the mounting frame 5 and thus above its upper edge. The cooking surface 7 thus merely rests on the upper side 13.

Figure 3:
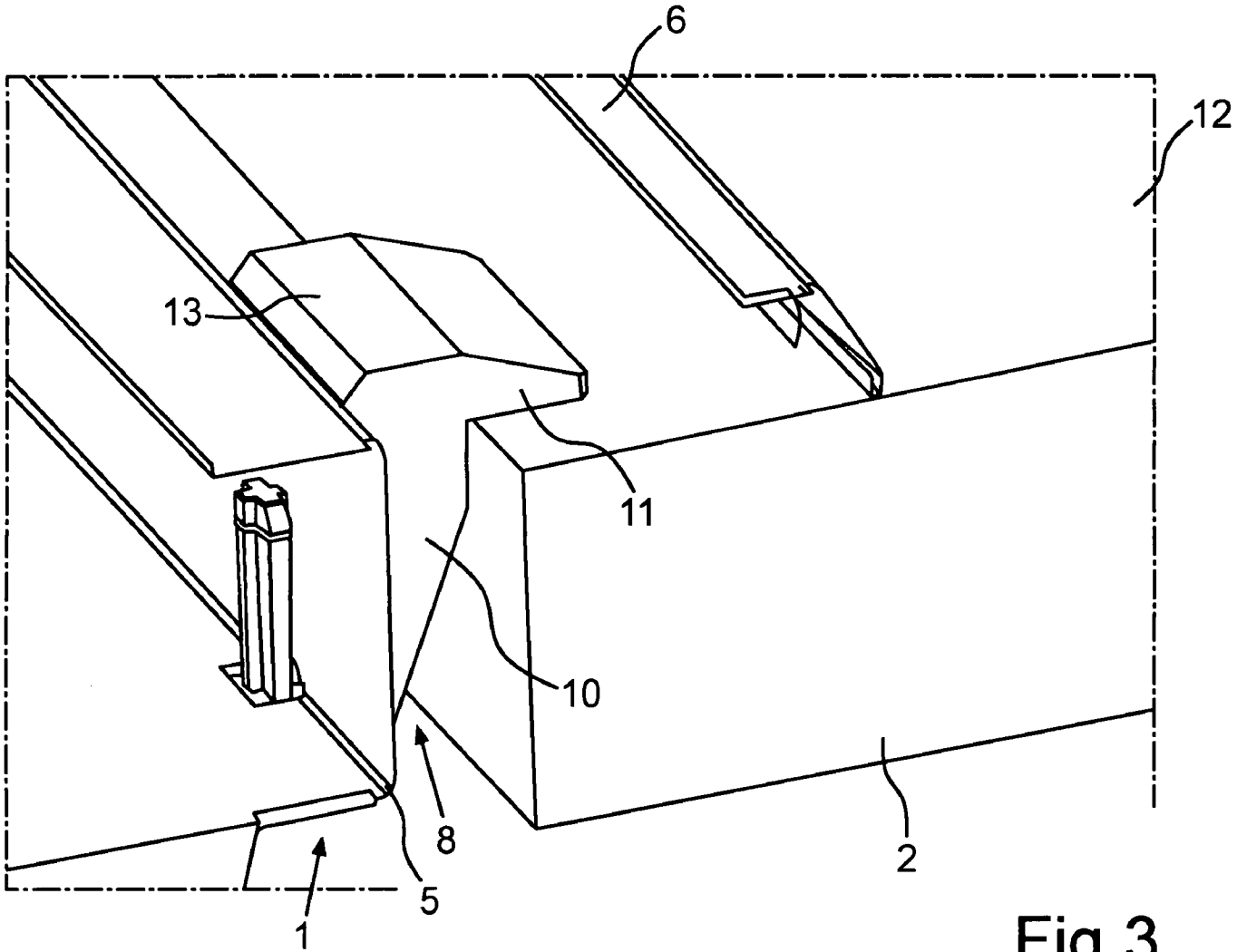
FIG. 3 an enlarged diagram of a section of FIG. 1.

FIG. 3 shows a perspective diagram of a section of the arrangement I in which a distance element 8 and its attachment position are shown in greater detail.

The invention claimed is:

1. An arrangement comprising:

a worktop having a recess;

a cooktop in the recess of the worktop and comprising a cooking surface, a mounting frame and a decorative frame; and a distance element between the cooktop and the worktop that positions the cooktop in the recess, wherein the cooking surface directly contacts the distance element and the distance element directly contacts the worktop such that downward forces exerted on the cooking surface are transmitted directly to the distance element and then directly from the distance element to the worktop.

2. The arrangement of claim 1, wherein the distance element comprises an angled element with a first part that extends into the recess and between an edge of the recess and the cooktop.

3. The arrangement of claim 1, wherein the distance element extends into the recess and wherein the mounting frame rests on the distance element.

4. The arrangement of claim 1, wherein the distance element comprises an angled element and a second part that rests on an upper side of the worktop.

5. The arrangement of claim 1, wherein the distance element rises above an upper side of the worktop and the cooking surface rests on the distance element.

6. The arrangement of claim 1, wherein the distance element is covered at a top by the cooking surface and to a side by the decorative frame of the cooktop.

7. The arrangement according to claim 6, wherein the distance element has a height above an upper side of the worktop such that the decorative frame is spaced from the upper side of the worktop.

8. The arrangement of claim 1, wherein an end of the distance element is tapered.

9. The arrangement of claim 8, wherein an end of the distance element is tapered toward the cooktop and another end of the distance element is tapered toward an upper side of the worktop.

10. The arrangement of claim 1, wherein the distance element has an upper side at a higher level than a front edge of the mounting frame of the cooktop.

11. The arrangement of claim 1, wherein the distance element is one piece.

12. The arrangement of claim 1, wherein the distance element comprises plastic.

13. The arrangement of claim 1, wherein the distance element prevents contact of the cooktop with the worktop.

14. A cooktop comprising:

a cooking surface;

a mounting surface for mounting the cooking surface in a recess of a worktop;

a decorative frame mounted to the cooking surface; and a distance element for spacing the cooking surface from a worktop, wherein the cooking surface directly contacts the distance element and the distance element is configured to directly contact the worktop such that downward forces exerted on the cooking surface are transmitted directly to the distance element and then directly from the distance element to the worktop.

15. The cooktop of claim 14, wherein the distance element comprises:

a first tapered part for extending between the mounting frame and the worktop; and a second tapered part for extending for extending between the cooking surface and an upper side of the worktop.

16. The cooktop of claim 14, wherein the distance element is covered at a top by the cooking surface and to a side by the decorative frame of the cooktop.

17. The cooktop of claim 16, wherein the distance element is configured to have a height above an upper side of the worktop such that the decorative frame is spaced from the upper side of the worktop.

18. A spacer for a cooktop arrangement comprising:

a first tapered part for extending between a mounting frame of the cooktop and a worktop; and a second tapered part for extending between a cooking surface of the cooktop and an upper side of the worktop.

19. The spacer of claim 18, wherein the second tapered part is configured to directly contact the cooking surface such that downward forces exerted on the cooking surface are directly transmitted to the second tapered part and then directly transmitted from the second tapered part to the worktop.

* * * * *